US006237350B1

(12) United States Patent
Hertel

(10) Patent No.: US 6,237,350 B1
(45) Date of Patent: May 29, 2001

(54) REFRIGERATED DISPLAY CASE AND METHOD FOR SANITIZING A REFRIGERATED DISPLAY CASE

(76) Inventor: Günther Hertel, Mörikestrasse 24, D-90491 Nürnberg (DE)

( * ) Notice: Subject to any disclaimer, the term of this patent is extended or adjusted under 35 U.S.C. 154(b) by 0 days.

(21) Appl. No.: 09/185,621

(22) Filed: Nov. 4, 1998

(30) Foreign Application Priority Data

Nov. 5, 1997 (DE) ..... 197 49 971

(51) Int. Cl.[7] ..... F24F 3/16
(52) U.S. Cl. ..... 62/78; 62/264
(58) Field of Search ..... 62/78, 264, 249, 62/303

(56) References Cited

U.S. PATENT DOCUMENTS

| | | | | |
|---|---|---|---|---|
| 3,561,230 | * | 2/1971 | Gatton et al. | 62/256 |
| 4,315,414 | * | 2/1982 | Ibrahim | 62/303 |
| 4,416,120 | * | 11/1983 | Yono et al. | 62/303 |
| 4,990,313 | * | 2/1991 | Pacosz | 62/78 |
| 5,755,103 | * | 5/1998 | Na et al. | 62/78 |
| 5,817,276 | * | 10/1998 | Fencl et al. | 62/78 |

FOREIGN PATENT DOCUMENTS

| | | | |
|---|---|---|---|
| 37 08 390 A1 | 9/1988 | (DE) | A47F/3/04 |
| 196 16 358 | 7/1997 | (DE) | A47F/3/04 |
| 196 11 842 A1 | 10/1997 | (DE) | A47F/3/04 |
| 196 41 474 A1 | 4/1998 | (DE) | A47F/3/04 |
| 0 312 060 | 4/1989 | (EP) . | |
| 0 797 944 A2 | 10/1997 | (EP) . | |
| 0 835 623 A2 | 4/1998 | (EP) . | |

* cited by examiner

*Primary Examiner*—William E. Tapolcai

(57) ABSTRACT

The invention relates to a refrigerated display case, includes a goods platform, a goods space arranged above the platform, a tub space that is arranged below the platform and is bordered by a display case tub, a blower, an evaporating apparatus and a UV sterilizing tube. The evaporating apparatus is arranged in the effective range of the UV sterilizing tube, which admits the evaporating apparatus during the defrosting, carried out with the aid of a hot-gas defrosting device.

27 Claims, 2 Drawing Sheets

REFRIGERATED DISPLAY CASE AND METHOD FOR SANITIZING A REFRIGERATED DISPLAY CASE

BACKGROUND OF THE INVENTION

The invention relates to a refrigerated display case, as well as a method for sainitizing such display cases. In refrigerated display cases, in particular the evaporating apparatus used to cool a circulating airflow causes sanitary problems. Microorganism that attach themselves to the cooling surfaces of an evaporating apparatus, e.g. bacteria, fungi or the like (in the following briefly referred to as "germs"), can multiply only to a negligible degree, owing to the low temperatures that prevail during the operation of the evaporating apparatus. However, the defrosting phases present a problem. Following a specific operating time, evaporating apparatuses generally become covered with ice. A sheet of ice on the cooling surfaces prevents the heat exchange or the cooling ability of the evaporating apparatus. For the defrosting, the supply of cooling agent to the evaporating apparatus is interrupted. In other words, a compressor that is generally arranged outside of the refrigerated display case or a refrigeration device containing a compressor is shut down, thereby allowing the ice that has formed on the cooling surfaces of the evaporating apparatus to melt. The danger during this process is that the number of germs in the condensation water will increase with increasing temperatures. Since the condensation water can low into places in the refrigerated display case that are not accessible or hard to access, every defrosting operation represents a sanitary risk for refrigerated display cases used until now.

SUMMARY OF THE INVENTION

It is the object of the invention to propose a refrigerated display case and a method for sanitizing a display case, which are improved from a sanitary point of view. This object is solved with respect to the refrigerated display case and to the sanitizing. A refrigerated display case according to the invention comprises on the one hand a defrosting device using hot gas for defrosting the evaporating apparatus and, on the other hand, a UV radiation source for treating the evaporating apparatus directly with the UV radiation during this process, the evaporating apparatus is admitted directly with UV radiation during the defrosting operation with hot gas. The use of a hot-gas defrosting method will first of all reduce the time required for defrosting the evaporating apparatus to approximately 15 minutes. A significant increase in the harmful germs at the evaporating apparatus is prevented simply because of the short defrosting time. Admitting the display case at the same time with UV radiation will not only prevent the additional reproduction of germs on the cooling surfaces or in the defrosting water, but will kill existing germs as well. Thus, in addition to the cooling surfaces of the evaporating apparatus, the defrosting water dripping down is also essentially germ-free. In this way, germs are prevented from reaching lower and hard to access areas of the refrigerated display case with the condensation water. The suggested defrosting method is so effective from a sanitary point of view that a sterilization of the circulating airflow during the normal operation of the display case can be omitted. It is furthermore advantageous that energy can be saved because the UV radiation source or the UV sterilizing tube is used for a short time only. During the relatively short defrosting phase, the temperature of the goods changes only insignificantly, that is to say by only 0.5 to 1° C. Owing to the proposed hot-gas defrosting, the goods therefore do not have to be removed.

A preferred hot-gas defrosting device provides that a hot-gas line with controllable shut-off valve is connected on the input side with the evaporating apparatus and on the output side with the compressor for the cooling apparatus. The cooling apparatus is preferably arranged at a distance to the refrigerated display case. For the hot-gas defrosting, it is only necessary to open the shut-off valve. The compressor pumps the cooling agent that is heated up during the compression directly into the evaporating apparatus. The hot-gas line may be a diathermal pipe, in particular a pipe made of copper. It has turned out that the defrosting of the evaporating apparatus takes place during a relatively short period of time, even if the "hot gas" supplied to the evaporating apparatus or the cooling agent is approximately at room temperature. An expensive insulation of the hot gas line can therefore be omitted. It may even be useful if the outside surface of the hot-gas pipe is enlarged by structures akin to cooling fins at suitable locations where relatively high environmental temperatures occur, so as to increase the heat absorption from the environment (claim 4).

The invention can provide that the evaporating apparatus is arranged in a region that is spatially separate from the goods area and the tub area. This separation occurs preferably with the aid of separating walls. Thus, the water flowing out of the evaporating apparatus during the defrosting operation cannot reach the tub area unchecked, which is surrounded by the display case wall. The evaporating apparatus furthermore can be accessed easily for regularly scheduled, thorough cleaning operations, owing to the fact that the air filter covering the exhaust opening can be removed. If, the blower is furthermore arranged in the ascent shaft between evaporating apparatus and air filter, this blower can also be cleaned easily from the outside or via the exhaust opening. This is also made easier by the fact that it can be tilted out. An arrangement of the blower in which it is located in the region where the UV sterilizing tube is effective, will prevent the formation of germs in the blower region or existing germs will be killed. The UV radiation source admits the evaporating apparatus as well as the blower if it is arranged between the blower and the evaperating apparatus.

The sanitary conditions of the display case are improved considerably in that a spraying device is arranged in the tub region, which sprays at least the tub bottom with cleaning fluid. The tub region in general can be cleaned with such a device. In connection with a defrosting of the evaporating apparatus, this measure results in a complete removal of the condensation water flowing from the evaporating apparatus to the tub bottom. This prevents condensation water from collecting in inaccessible spots, thereby serving as location where germs can breed. The spraying device preferably comprises a spray head that is arranged on the tub bottom. The discharge openings or spray openings of the spray head in this case are preferably aligned in such a way that for the most part the bottom region rather than the underside of the goods platform is admitted with cleaning fluid. It is advantageous if the spraying device is supplied directly from the supply of potable water. A separate spraying device is proposed for additionally spraying a cleaning fluid into the tub region or onto the tub bottom to increase the cleaning effect of the water. The spraying device can also be supplied from a container holding a cleaning fluid that already contains a cleaning agent, e.g. with the aid of a pump. The spray device is particularly effective if, the tub region contains as few built-in parts as possible.

Another advantageous embodiment of the display case according to the invention provides for a control device, which makes it possible to control the hot-gas defrosting device, the spray device, the blower as well as the UV sterilizing tube. In that case, the defrosting operations or the cleaning operations are performed automatically, without requiring any operating personnel. The control device is preferably connected to an automatic control device for cooling the refrigerated display case. The cleaning or defrosting operations are preferably carried out during predetermined time intervals that can be adjusted on the control device.

BRIEF DESCRIPTION OF THE DRAWINGS

The invention is explained in further detail with the aid of an exemplary embodiment shown in the enclosed drawings with.

DETAILED DESCRIPTION OF THE PREFERRED EMBODIMENTS

Figure 1:
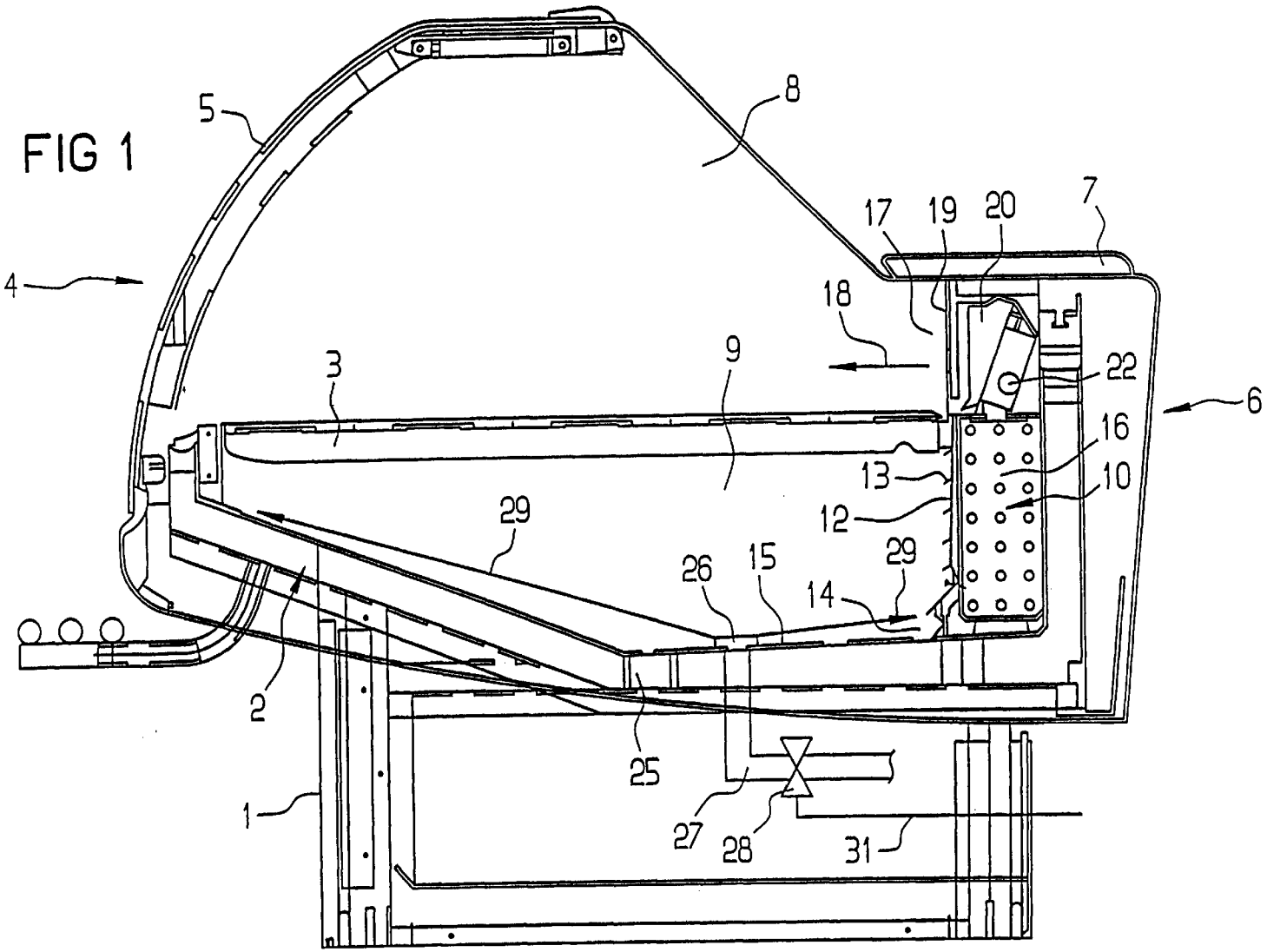
FIG. 1 is a schematic cross section of a refrigerated display case.

FIG. 1 illustrates a display case according to the invention, which comprises a case body 1 as the main component, a therein embedded case tub 2, a goods platform 3, a front panel 5 on the client side 4 of the display case, a worktable 7 on the service side 6 of the display case, a space 8 for displaying the goods above the goods platform, and a tub space 9 that is arranged below the goods platform 3 and is surrounded by the display case 2. An ascent shaft 10 is arranged on the service attendant's side 6, which is essentially separated from the tub space 9 by a vertically arranged separating wall 12, extending in longitudinal direction of the case. On the side pointing toward the tub space, several longitudinal rails 13 are arranged, which are used to adjust the height of the goods platform 3. The separating wall 12 does not completely extend to the bottom, but leaves a flow-in opening 14 between its lower edge and the tub bottom 15. The air circulating inside the case can enter through this flow-in opening into the ascent shaft and can flow past an evaporating apparatus 16, arranged therein. At the upper end of the ascent shaft, the cooled air flows through an exhaust opening 17 in flow direction 18 into the tub space 8. The exhaust opening 17 is covered by an air filter 19. attached such that it can be removed, which can be tilted, in particular, in the direction of the goods space 8. At least one blower 20, the lower end of which can pivot, is arranged in front of the air filter 19 as seen in flow direction, such that it can be pivoted out for easier cleaning once the air filter 19 is tilted out or removed. A UV sterilizing tube 22 that extends in longitudinal direction of the display case is positioned between the blower 19 and the evaporating apparatus 16. During the defrosting phases, the UV sterilizing tube 22 admits the evaporating apparatus 16 or its cooling surfaces and the blower with UV radiation. The UV sterilizing tube is turned off during normal operations of the display case. The refrigerated display case comprises a control device 23 (see FIG. 2), which can be used to switch on the UV sterilizing tube when the evaporating apparatus is defrosted, as well as to control and monitor other functions of the refrigerated display case.

During the normal operation of a refrigerated display case, the at least one blower 20 is turned on and circulates the air in flow direction 18. The air and accordingly the goods 49 placed on the goods platform 3 are cooled with the aid of an evaporating apparatus that is connected to a refrigeration device (see FIG. 2). The airflow continuously absorbs moisture from the goods and also from the environment, which moisture then condenses on the evaporating apparatus 16. With continued operation, the condensation water will freeze to a continuously growing layer of ice and prevent a proper cooling of the circulated air. For that reason, the evaporating apparatus is defrosted at regular intervals, e.g. prior to the start of sales and at the end of the business day, as follows: a cooling apparatus that operates jointly with the evaporating apparatus 16 is switched off. However, at least one blower 20 continues to operate in order to accelerate the warming up and thus the defrosting of the evaporating apparatus. The defrosting water flows downward on the evaporating apparatus and finally reaches the tub bottom 15 that is slanted toward a drain opening 25. The UV sterilizing tube 22 is operational during the defrosting and admits the cooling surfaces of the evaporating apparatus 16 with UV radiation. The UV radiation prevents the germs present in the defrosting water or present on the evaporating apparatus from multiplying during the high temperatures of the defrosting phase. Existing germs are killed. The blower 20 and the wall regions of the ascent shaft 10, which are located in the effective range of the UV sterilizing tube 22, are sterilized at the same time. A spray head 26 is arranged on the tub bottom 15, next to the drain opening 25, which spray head is fed from the supply of potable water via a supply line 27 with a shut-off valve 28 connected in-between. The spray head 26 is adjusted such that it ejects the cleaning fluid or the water in spraying direction 29. The spraying direction of spray head 26 extends relatively close to the tub bottom 15. Thus, the cleaning fluid can also reach the tub bottom 15 region below the evaporating apparatus 16 via the flow-in opening 14. The spray arrangement, comprising the spray head, the supply line 27 and the shut-off valve 28, does not have to be used for each defrosting operation. The spray arrangement is activated with a control device 23, which is connected to the shut-off valve 28 via signal and the control line 31. The water ejected by the spray head 26 completely washes away the condensation water that flows down to the tube bottom from the evaporating apparatus 16 during the defrosting operation. As a result of the inclined tub bottom, the fluid drains toward the drain opening 25 and from there into the sewer system. On the outside of the tub 2 for the display case, a siphon trap (not shown) is installed after the drain opening 25.

Figure 2:
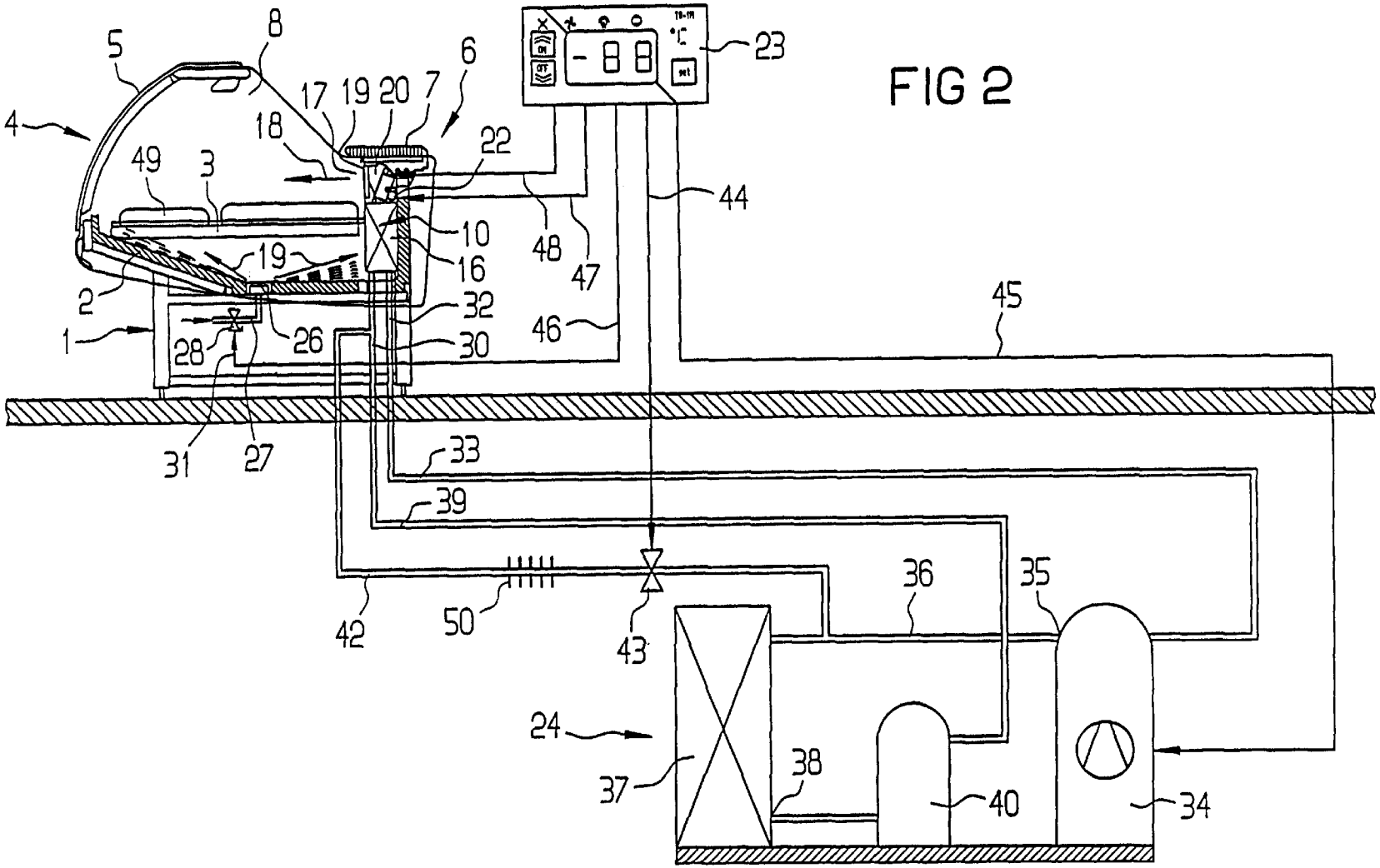
FIG. 2 is a refrigerated display case according to FIG. 1, as well as a hot-gas defrosting device, connected to it.

FIG. 2 shows that the evaporating apparatus 16 or its connection to the refrigeration device 24 is designed so as to permit a defrosting with hot gas. The refrigeration device 24 is located outside of the refrigerated display case, e.g. in a space below the location where the refrigerated display case is set up. The evaporating apparatus 16 has an evaporator intake 30 and an evaporator outlet 32. The evaporator outlet 32 is connected via a suction line 33 to the intake of a compressor 34. The compressor outlet 35 is connected to a condenser 37, so as to transport fluid via a pressure line 36. A supply line 39 leads from the condenser outlet 38 via a collector 40, connected in series inside the refrigeration unit 24, to the evaporating apparatus inlet 30. Near the evaporating apparatus inlet 30, a hot-gas line 42 branches off from the feed line 39 and empties near the heat exchanger 37 into the pressure line 36. The hot-gas line 42 goes around the condenser 37 in the form of a bypass. A hot-gas shut-off valve 43 is installed in the hot-gas line 42, which valve can be actuated by a control device 23 via a control line 44. The control device 23 furthermore controls the compressor 34 via a control line 45, the shut-off valve 28 for the spraying arrangement via a control line 46, the UV sterilizing tube 22 via a control line 47, as well as the at least one blower 20 via a control line 48.

The described cooling or hot gas defrosting device operates as follows: During normal operations, the blower 20 and the refrigeration system 24 are operational. A circulating airflow with flow direction 18 is generated for cooling the goods 49 resting on the goods platform 3. The control device 23 can be adjusted so as to initiate a defrosting operation at specific intervals, e.g. at the start or end of a business day. For this, the hot-gas shut-off valve 43 is initially opened. As a result, the cooling agent, which is heated up during the compressing operation, is supplied directly to the hot-gas line 42 by circumventing the heat-exchanger 37 and from there travels via the evaporating apparatus inlet 30 into the evaporating apparatus 16. Relatively low amounts of energy are required for defrosting the evaporating apparatus, since it is not operated in the deep-freezing range. Accordingly, the hot-gas line 42, which in some circumstances can be very long, does not have to be insulated. It is sufficient if the cooling agent, supplied via the line 32 to the evaporating apparatus 42, is at the environmental temperature to maintain a sufficiently short defrosting time. The selection of a suitable line material will ensure the heat exchange between the wall of line 42 and the environment. A copper pipe is preferably used for the hot-gas line 42. It may be advisable to enlarge the outer surface of the hot-gas line 42 with structures, designed approximately like cooling fins 50, in order to increase the heat absorption from the environment. It makes sense to arrange cooling fins 50 at those locations along line 42, where an increased room temperature is present. After the hot-gas shut-off valve 43 has been opened, the at least one UV sterilizing tube 22 is made operational. Owing to the spatial closeness of the UV sterilizing tube to the evaporating apparatus 16, the cooling surfaces of this apparatus are admitted with UV radiation, thus preventing germs from growing during the defrosting phase. The defrosting is simultaneously accelerated due to the heat emitted by the sterilizing tube. With a time delay, approximately toward the end of the defrosting operation, the shut-off valve 28 is opened for about 5 to 10 seconds. As a result of this, fresh water is sprayed via the spray head 26 into the display case tub 2 or the tub space 9. The water that has dripped off the evaporating apparatus is washed down the drain opening 25. The same is true for solid particles, which have collected on the tube bottom 15. The refrigeration unit or the compressor 34, as well as the blower 20 are operational during the defrosting operation. The air circulated by the blower is cooled at the evaporating apparatus and prevents the goods 49 resting on the goods platform 3 from being heated up. The defrosting operation is completed if the evaporating apparatus 16 has reached a predetermined temperature level, which is read by a temperature sensor (not shown).

The control or the program sequence of the control system can be selected such that a cleaning of the display case tub 2 with water or cleaning fluid does not take place during each defrosting operation.

As explained in the above, the display case tub can be cleaned through supplying water directly from the drinking water supply. A storage container for cleaning fluid can be provided as a further option, e.g. in the display case body 1, wherein the cleaning liquid is pumped via a pump to the spray head 26 (not shown). This embodiment allows adding a cleaning agent to the cleaning fluid in the storage container. When potable water is supplied directly, the cleaning agent is supplied to the tub space 2 via a separate spray device (not shown).

What is claimed is:

1. A refrigerated display case for refrigerated goods, comprising:

a platform to support the goods having a first space above the platform;

a tub located below the platform having a second space above the tub and below the platform;

a blower that circulates air from the second space to the first space;

an evaporating apparatus that cools the air circulated by the blower and operates in a cooling mode and a defrosting mode;

a hot-gas defrosting device connected to the evaporating apparatus that provides hot-gas to the evaporating apparatus when the evaporating apparatus is operating in the defrosting mode; and a UV sterilizing tube that emits UV radiation directly upon the evaporating apparatus when the evaporating apparatus in operating in the defrosting mode.

2. A refrigerated display case according to claim 1, wherein the UV sterilizing tube emits the UV radiation only when the evaporating apparatus is operating in the defrosting mode.

3. A refrigerated display case according to claim 1, comprising a hot-gas line that connects an outlet compressor of a refrigeration unit to an inlet of the evaporating apparatus; and a shutoff valve disposed in the hot-gas line to selectively control flow through the hot-gas line, wherein the compressor is separate from the display case.

4. A refrigerated display case according to claim 3, wherein the hot-gas line is a copper diathermal pipe.

5. A refrigerated display case according to claim 4, further comprising cooling fins located on a portion of the hot-gas line to increase the surface area of the hot-gas line.

6. A refrigerated display case according to claim 5, further comprising a controller that activates the defrost mode of the evaporating apparatus at predetermined time intervals.

7. A refrigerated display case according to claim 1, further comprising an air shaft arranged on one side of the display case through which air flows upward vertically, and which is separated from the second space, and extends from the second space to the first space and has an exit opening adjacent the first space, wherein the evaporating apparatus is disposed in the air shaft; and;

a removable air filter that covers the exit opening of the air shaft.

8. A refrigerated display case according to claim 7, wherein the blower is arranged in the shaft and located between the evaporating apparatus and the air filter.

9. A refrigerated display case according to claim 8, wherein the blower can be tilted out of the exhaust opening.

10. A refrigerated display case according to claim 8, wherein the blower and UV sterilizing tube are positioned so that the UV sterilizing tube emits UV radiation onto the blower.

11. A refrigerated display case according to claim 10, wherein the UV sterilizing tube is located between the blower and the evaporating apparatus.

12. A refrigerated display case according to claim 1, wherein the tub has a drain opening and a bottom surface slanted toward the drain opening, and the display case comprises a spray device arranged above the bottom surface that admits the bottom surface with cleaning fluid.

13. A refrigerated display case according to claim 11, wherein the spray device comprises at least one spray head located proximate to the bottom surface of the tub.

14. A refrigerated display case according to claim 11, wherein the display case is used with a communal supply of potable water, and the spray device is supplied directly from the communal supply of potable water.

15. A refrigerated display case according to claim 11, wherein the display case is used with a supply of cleaning agent, and the display case comprises a second spray device for applying the cleaning agent which is separate from the first spray device.

16. A refrigerated display case according to claim 11, further comprising a storage container located underneath the tub for supplying fluid to the first spray device.

17. A refrigerated display case according to claim 11, wherein the second space defines an unobstructed free volume.

18. A refrigerated display case according to claim 1, further comprising a control device for controlling the operation of the mode of the evaporating apparatus, the operation of the blower and the operation of the UV sterilizing tube.

19. A refrigerated display device according to claim 12, further comprising a control device for controlling the operation of the mode of the evaporating apparatus, the operation of the blower, the operation of the spray device and the operation of the UV sterilizing tube.

20. A method of sanitizing a refrigerated display case for refrigerated goods that has a platform to support the goods; a tub located below the platform; a blower that circulates air from the tub to a space above the platform; an evaporating apparatus that cools the air circulated by the blower and operates in a cooling mode and a defrosting mode; a hot-gas defrosting device connected to the evaporating apparatus; and a UV sterilizing tube, comprising the steps of:

supplying hot-gas to the evaporating apparatus when the evaporating apparatus is in the defrosting mode; and emitting UV radiation onto the evaporating apparatus when the evaporating apparatus is in the defrosting mode.

21. A method according to claim 20, wherein the step of emitting UV radiation onto the evaporating apparatus is performed only when the evaporating apparatus is in the defrosting mode.

22. A method according to claim 20, further comprising the step of flushing water that drips to the bottom surface of the tub from the tub by applying at least one of water and a cleaning fluid.

23. A method according to claim 20, wherein the step of supplying the hot-gas comprises a step of supplying heated coolant agent from a compressor of a refrigeration unit directly to the evaporating apparatus.

24. A method according to claim 23, wherein the cooling agent supplied to the evaporating apparatus is supplied at approximately room temperature.

25. A method according to claim 20, further comprising the step of controlling the defrosting mode of the evaporating apparatus and the emission of the UV radiation by automatic control.

26. A method according to claim 22, further comprising the step of controlling the flushing of the water by automatic control.

27. A method according to claim 20, further comprising the step of switching the blower on/off by an automatic control.

* * * * *

UNITED STATES PATENT AND TRADEMARK OFFICE

CERTIFICATE OF CORRECTION

PATENT NO. : 6,237,350 B1
DATED : May 29, 2001
INVENTOR(S) : Günther Hertel

It is certified that error appears in the above-identified patent and that said Letters Patent is hereby corrected as shown below:

Title page,
Line 74, Attorney, Agent or Firm should read as follows:
-- (74) *Attorney, Agent or Firm* - Venable; George H. Spencer; Robert Kinberg --.

Signed and Sealed this

Eighth Day of January, 2002

*Attest:*

*Attesting Officer*

JAMES E. ROGAN
*Director of the United States Patent and Trademark Office*